United States Patent [19]

Fuerschbach et al.

[11] Patent Number: 4,872,578

[45] Date of Patent: Oct. 10, 1989

[54] PLATE TYPE HEAT EXCHANGER

[75] Inventors: Raymond F. Fuerschbach, Tonawanda; Timothy P. Creighton, Buffalo; David F. Fijas, Depew, all of N.Y.

[73] Assignee: ITT Standard of ITT Corporation, Buffalo, N.Y.

[21] Appl. No.: 209,228

[22] Filed: Jun. 20, 1988

[51] Int. Cl.[4] ..... F28F 3/08

[52] U.S. Cl. ..... 165/167; 165/166

[58] Field of Search ..... 165/166, 167

[56] References Cited

U.S. PATENT DOCUMENTS

| | | | |
|---|---|---|---|
| 2,550,339 | 8/1948 | Ehrman | 165/167 |
| 2,596,008 | 5/1952 | Collins | 165/166 |
| 2,777,674 | 1/1957 | Wakeman | 165/167 |
| 2,865,613 | 12/1958 | Egenwall et al. | 165/167 |
| 3,114,686 | 12/1963 | Edwards et al. | 204/99 |
| 3,360,038 | 12/1967 | Stampes | 165/166 |
| 3,590,917 | 7/1971 | Huber et al. | 165/167 |
| 4,002,201 | 1/1977 | Donaldson | 165/140 |
| 4,006,776 | 2/1977 | Pfouts et al. | 165/166 |
| 4,014,385 | 3/1977 | Wright | 165/167 |
| 4,340,114 | 7/1982 | Levy | 165/110 |
| 4,398,596 | 8/1983 | Lauro et al. | 165/167 |
| 4,561,494 | 12/1985 | Frost | 165/167 |
| 4,569,391 | 2/1986 | Hulswitt et al. | 165/166 |
| 4,586,562 | 5/1986 | Carlson et al. | 165/134.1 |
| 4,653,581 | 3/1987 | Yogo et al. | 165/166 |
| 4,708,199 | 11/1987 | Yogo et al. | 165/167 |

FOREIGN PATENT DOCUMENTS 805215 12/1958 United Kingdom ..... 165/166

OTHER PUBLICATIONS

PCT/SE86/00140, "Device at a Plate Heat Exchanger", Erik Hedman, 3/1986, European Patent Appl. 85112297.8, Port Bushings for Internally Manifolded Stacked, Finned Plate Heat Exchanger, Rosman, 4/1986.

Clad Metals, by Texas Instruments, 1983.

*Primary Examiner*—Ira S. Lazarus

*Assistant Examiner*—Christopher Hayes

*Attorney, Agent, or Firm*—Menotti J. Lombardi

[57] ABSTRACT

A stacked plate heat exchanger is disclosed which includes heat exchange plates arranged in stacked relation, each of the plates including a peripheral flange. Each plate includes two types of flow openings, one type being formed as part of a depression therein, the other being substantially coplanar with the plate surface. The flow openings within the depressions adjoin the coplanar flow openings of the plate positioned immediately therebelow. Additional projections and depressions are formed between the flow openings of each plate to support it against similar projections and depressions formed in adjacent plates. A turbulator is positioned between and helps support each adjoining pair of heat exchange plates. Fluid is introduced to the heat exchanger by means of a nozzle having a base portion locked between a top plate and one of the heat exchange plates.

23 Claims, 3 Drawing Sheets

PLATE TYPE HEAT EXCHANGER

BACKGROUND OF THE INVENTION

Plate-type heat exchangers are being more widely used for certain industrial applications in place of fin and tube or shell and tube type heat exchangers because they are less expensive and easier to make than most forms of heat exchangers. In one form of such heat exchangers, a plurality of plates are clamped together in a stacked assembly with gaskets located between adjacent plates and traversing a course adjacent to the plate peripheries. Flow of the two fluids involved in heat exchange is through the alternate ones of the layers defined by the clamped plates.

The stacked plates also can be joined together as a unitary structure by brazing the various components together. U.S. Pat. No. 4,006,776 discloses a plate heat exchanger made in such manner. U.S. Pat. No. 4,569,391 discloses a plate heat exchanger in which plural parallel spaced plates are welded together. The space between plates is occupied by nipple-like protuberances formed in the plates and which serve to increase turbulence in the fluid flow. All of the fluid flowing in a given defined space is in contact with the plates to thereby enhance heat transfer.

U.S. Pat. No. 4,653,581 discloses a heat exchanger including a plurality of stacked plates, each plate including a pair of opposing, downwardly projecting walls and a pair of opposing, upwardly extending walls. The downwardly projection walls are bent outwardly so as to fit within the corresponding walls of the plate above it. U.S. Pat. No. 4,708,199 also discloses a plate type heat exchanger wherein each plate includes a flat section and a plurality of annular flanges protruding from the flat section.

U.S. Pat. No. 4,561,494 discloses the employment of a turbulator, i.e., a turbulence producing device, in a plate heat exchanger. U.S. Pat. No. 4,398,596 discloses another construction of a plate heat exchanger in which spaced, rectangular-shaped plates define a succession of fluid flow passages, the alternate ones of which are associated with the flow of the two fluids involved in heat exchange. The plates have four orifices located at the four plate corners. Two of these orifices are associated with one fluid flow and the other two with the second fluid flow. The orifices are aligned with tubular passages leading to the various fluid flow passages.

While plate heat exchangers of known construction and as exemplified in the aforementioned U.S. patents, have the advantage of being less complicated and more easily fabricated than fin and tube types, many employ components that involve unnecessary assembly steps or possess shapes that entail undesirable shaping procedures. Further, they require maintaining a components inventory that could be reduced if a more simplified plate heat exchanger construction optimizing standardized components usage was provided. With a standardized system, it would be possible to provide a stacked plate exchanger that could be produced economically and efficiently on demand with a variety of different interchangeable structures to satisfy a wide variety of needs.

SUMMARY OF THE INVENTION

An object of the present invention is to provide a plate type heat exchanger which is easily, economically and efficiently fabricated. For such purpose, plate components of simple structural character are employed thereby reducing the need for special components shaping devices and stocking of a multiplicity of different shaped elements.

Another object is to provide a plate heat exchanger having heat transfer cells which can be embodied in a compact heat exchanger structure for a wide range of industrial and/or commercial applications.

Still another object of the invention is to provide a light weight heat exchanger having sufficient strength to withstand high pressure.

A still further object of the invention is to provide a heat exchanger having as few component parts and brazed joints as possible, thereby reducing the potential for leakage.

A still further object of the invention is to provide improved connections for introducing fluids to a heat exchanger.

In accordance with these and other objects, a heat exchanger is provided which includes a plurality of heat exchange plates, each plate including an integral, peripheral flange or rim defining an obtuse angle with respect to the plate, the exterior surface of each peripheral flange being secured to the interior surface of the flange of the heat exchange plate positioned immediately above.

Each heat exchange plate preferably includes a central area, which may or may not include a depression formed therein, for supporting a turbulator. Relatively small depressions or projections are formed in each plate to provide reinforcement when the plate is under operating or testing pressure. Each plate preferably includes both integrally formed depressions and projections. The smaller depressions within each plate are arranged directly above corresponding projections of the plate positioned immediately below. Likewise, the projections extending upwardly from each plate are positioned directly beneath the relatively small depressions extending from the plate positioned immediately above. The corresponding depressions and projections of adjacent plates are preferably in abutting relation to each other so that they may be sealed together by brazing.

The heat exchanger provided by the invention further includes a top plate which is preferably relatively thicker than the heat exchanger plates. One or more nozzles are secured to the heat exchanger by interlocking the nozzle base portions between the top plate and the heat transfer plate adjacent to the top plate. Internal pressure within the heat exchanger will accordingly tend to tighten the brazed joint between the nozzle base and the top plate the brazed joint being in compression rather than in shear or tension when such internal pressure is applied.

DETAILED DESCRIPTION OF THE INVENTION

Figure 1:
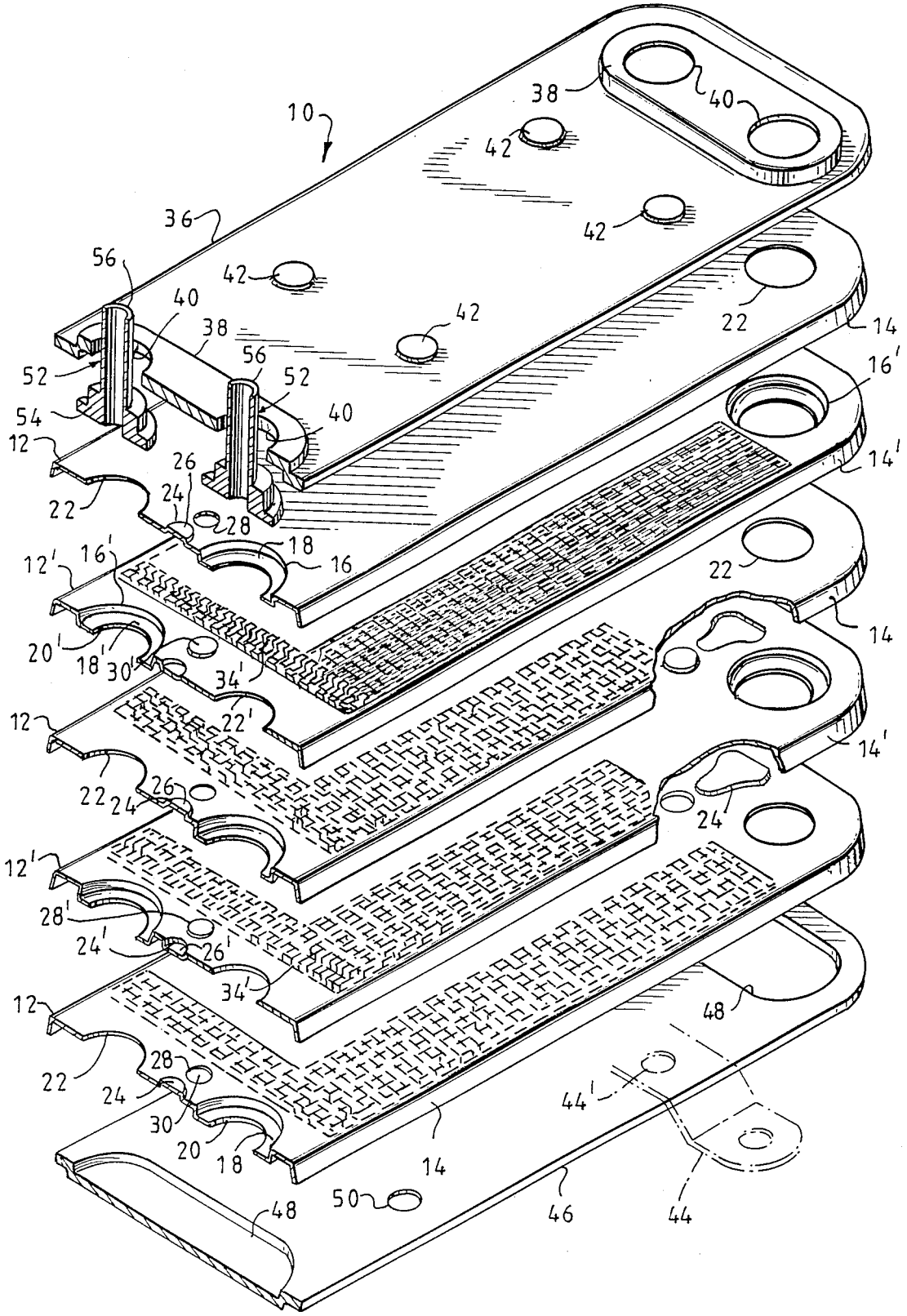
FIG. 1 is an exploded partially cutaway perspective view of a heat exchanger in accordance with the invention.
Figure 2:
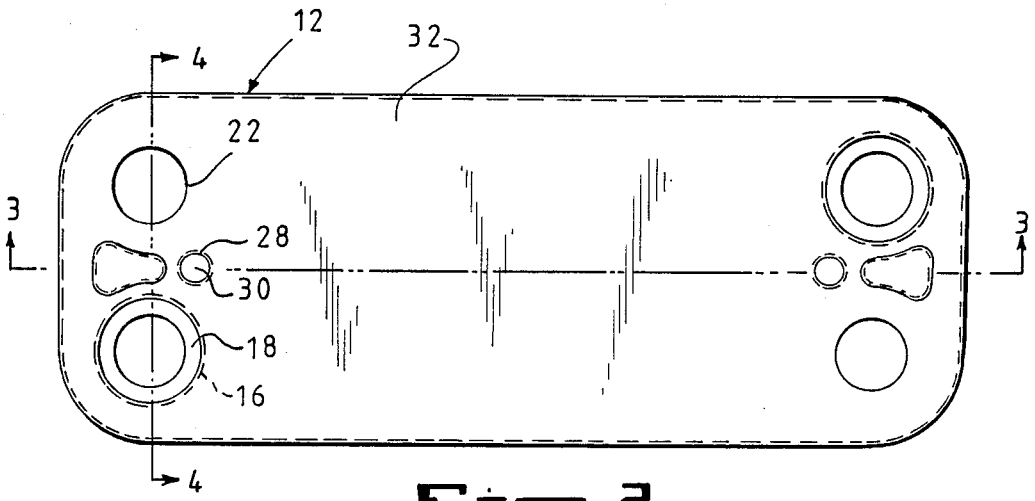
FIG. 2 is a top plan view of a first type of heat exchange plate shown in FIG. 1.
Figure 3:
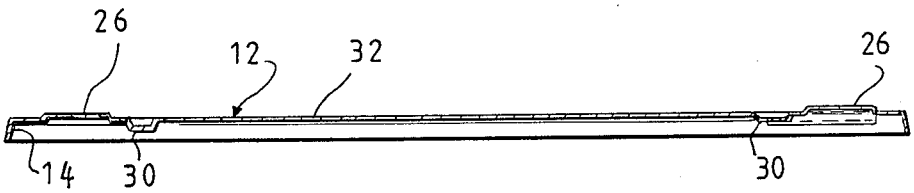
FIG. 3 is a sectional view thereof taken along line 3—3 of FIG. 2.
Figure 4:
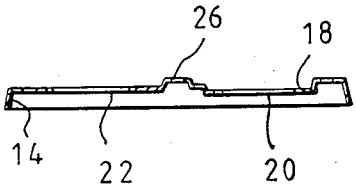
FIG. 4 is a sectional view thereof taken along line 4—4 of FIG. 2.
Figure 5:
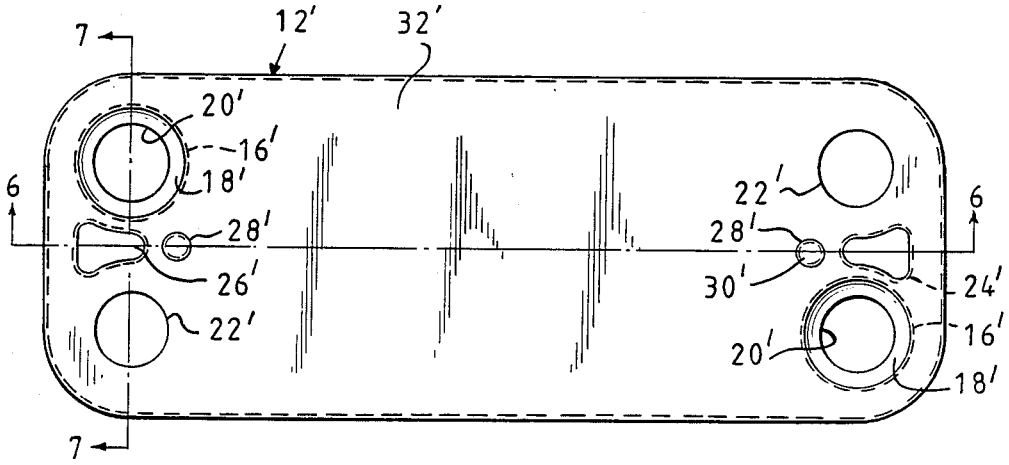
FIG. 5 is a top plan view of a second type of heat exchange plate shown in FIG. 1.
Figure 6:
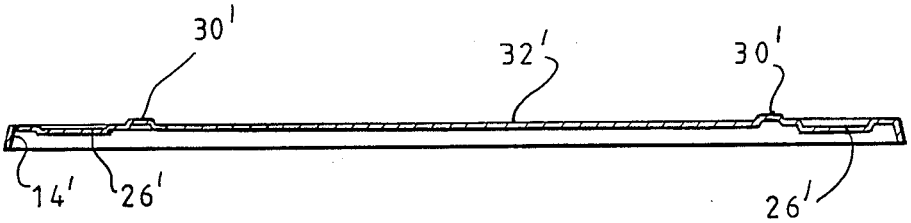
FIG. 6 is a sectional view thereof taken along line 6—6 of FIG. 5.
Figure 7:
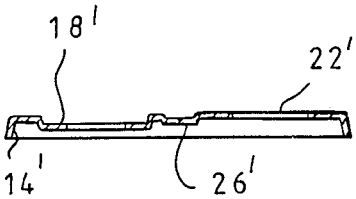
FIG. 7 is a sectional view thereof taken along line 7—7 of FIG. 5.

A plate type heat exchanger 10 as shown in FIG. 1 is provided. The heat exchanger includes a plurality of substantially rectangular heat exchange plates 12, 12', the "odd" numbered plates (counting from the bottom) being designated by numeral 12 while the "even" numbered plates are designated by the numeral 12'. Each plate includes an integral, peripheral, downwardly extending flange 14 or 14', the flange defining an angle of slightly greater than ninety degrees with respect to the bottom surface of the heat exchange plate. It will be appreciated that terms such as up and down are used in their relative rather than absolute sense as the heat exchanger 10 may be employed in any suitable orientation. The inner surface of each flange is supported by the exterior surface of the flange of the heat exchange plate positioned immediately below.

Each odd numbered heat exchange plate includes a pair of first circular depressions 16 formed near the diagonally opposing corners thereof. Each depression 16 includes a substantially flat, annular base portion 18 having a circular first flow opening 20 extending therethrough. The two other diagonally opposing corner portions of the odd numbered heat exchange plates 12 each includes a second circular flow opening 22 extending therethrough.

A pair of generally triangular-shaped projections 24 extend upwardly with respect to the plate surface and are in substantially opposing relation with respect to each other. Each is positioned substantially between the respective pairs of depressions 16 and openings 22 adjacent the relatively short sides of the heat exchange plate. The projections 24 each have a substantially flat upper surface 26.

A pair of second circular depressions 28, each having a substantially flat base portion 30, extend downwardly with respect to the flat section of each heat exchange plate 12. Each circular depression and triangular projection 24 is located along the longitudinal center line of the rectangular plate 12, the depressions being positioned inside the respective projections.

A relatively large, central heat transfer section 32 is generally defined by the opposing projections 24 and the downwardly extending flanges of the heat exchange plate located directly above. A turbulator 34 is positioned upon this section for causing turbulent flow conditions across the heat transfer plate. The configuration of the turbulator is selected to provide the desired amount of heat transfer and/or pressure drop between adjacent plates.

Each even numbered plate 12' is, of course, stacked in alternating relation with the odd numbered plates 12. Their construction is similar to the odd numbered plates in that they include substantially flat sections having downwardly extending peripheral flanges 14', diagonally opposed circular openings 22', and diagonally opposed, first circular depressions 16' including substantially flat, annular base portions 18' having circular openings 20' extending therethrough. The openings 22' and depressions 16' are, however, formed in the opposite corners from the corresponding openings 22 and depressions 16 in the odd numbered plates Each even numbered plate also includes a relatively large, central, heat transfer section 32' for receiving a turbulator 34'. The turbulators within the odd and even numbered plates may or may not be identical in structure.

A pair of generally triangular-shaped, second depressions 34' extend downwardly with respect to the flat surface of the plate 12'. Each depression includes a substantially flat base 26'.

A pair of circular projections 28', each having a substantially flat upper surface 30', extend upwardly with respect to the flat section of the heat exchange plate 12'. Each circular projection and triangular depression 24' is located along the longitudinal center line of the plate 12', the projections 28' being positioned inside the respective depressions 24'.

The top plate 36 of the heat exchanger 10 is substantially flat as peripheral flanges are not required. While the heat exchange plates may be stamped from materials such as 26 gauge copper clad steel, the top and bottom plates may be fabricated from thicker stock to provide greater strength.

The top plate 36 includes a pair of opposing, oval-shaped projections 38, each such projection including a pair of openings 40. Four circular projections 42 extending therefrom serve as locators for support feet 44 (shown in conjunction with the bottom plate only) and add to the strength of the plate in the lateral and horizontal directions.

The bottom plate 46 includes a pair of opposing oval depressions 48 and four circular depressions 50 positioned therebetween. It is also stamped from thicker gauge stock than the heat transfer plates.

A pair of substantially identical inlet and/or outlet nozzles 52 are shown in FIG. 1. Each nozzle includes a double-stepped base 54 from which a cylindrical conduit 56 extends. A portion of each nozzle base, including the bottom step, is positioned between the top plate 36 and the adjacent heat exchange plate 12. The base 54 of one of the nozzles is secured to the flat, annular base portion 18 of one of the circular depressions 16. The base of the other of the two illustrated nozzles is mounted to the flat upper surface of the heat exchange plate 12. The construction provides an improved fluid entrance area with lower pressure drop.

The heat exchanger 10 is easily assembled. A turbulator 34, 34' is mounted to each of the heat exchange plates. The turbulators may be of identical or different constructions to provide the desired heat exchange between plates. They may also be oriented in different directions to provide different degrees of turbulence.

Each of the plates is stacked in the manner shown in FIG. 1, the peripheral flanges 14, 14' insuring that the alignment of the plates will be correct. The base portions of the nozzles 52 are positioned between the top plate 36 and the adjacent heat exchange plate 12. The bottom plate 46 is positioned beneath the bottom or first heat exchange plate 12, the annular base portions 18 of the depressions 16 being positioned upon the upper surfaces of the bottom plate depressions 48.

The top, bottom, and heat exchange plates all include a copper cladding on both sides thereof. The turbulators accordingly do not require such a coating. The stacked assembly is heated to form brazed connections along all surfaces where the plates contact the turbulators or each other. Such contacting surfaces include the adjoining peripheral flanges 14, 14', the turbulators 34, 34' and the plate surfaces above and below them, the adjoining triangular projections and depressions 24, 24', the adjoining circular depressions and projections 28, 28', and the nozzle base 54 and the top plate 36 and heat exchange plate 12. The annular base portions 18, 18' about each flow opening 20, 20' will also be brazed to the flat surface of the heat exchange plate positioned immediately below such that each such flow opening is aligned, respectively, with the flow openings 22, 22' defined in such plates.

Finally, the support feet 44 may be brazed or otherwise secured to the bottom and/or top plates, the depressions 50 and/or projections 42 extending within the corresponding openings 44' within the upper, flat surface of the support feet.

In operation, a fluid introduced through the nozzle 52 mounted to the annular base portion 18 of the top heat exchange plate 12 will bypass the uppermost flow path defined between the two plates 12, 12' nearest the top plate. The fluid will instead pass between the second and third plates from the top plate and each alternating set of plates therefrom. A second fluid will flow in each of the remaining attenuating flow paths in either the same direction as the first fluid or opposite thereto.

The heat exchanger 10 provided by the invention includes many advantageous features. It includes only a small number of parts, is easy to assemble, and is light in weight. The heat exchange plates are self-aligning, thereby reducing the possibility of leakage subsequent to brazing. The nozzles are mounted to the heat exchanger in such a manner that internal pressure tends to tighten the brazed joint between the connection and the top plate rather than placing it under tension. The heat exchange plates are also protected under pressure by the projections and depressions formed therein and the turbulators positioned therebetween.

What is claimed is:

1. A plate type heat exchanger comprising:

a plurality of first heat exchange plates arranged in stacked relation, each of said first heat exchange plates including a first heat transfer section, a peripheral flange extending downwardly from said first heat transfer section, a first depression extending downwardly from said first heat transfer section and including a first flow opening extending therethrough, a second flow opening defined within said first heat transfer section, a first projection extending upwardly from said first heat transfer section, and a second depression extending downwardly from said first heat transfer section;

a plurality of second heat exchange plates arranged in alternating, stacked relation with said first heat exchange plates, each of said second heat exchange plates including a second heat transfer section, a peripheral flange extending downwardly from said second heat transfer section and including a first flow opening extending therethrough, a second flow opening defined within said second heat transfer section, a first projection extending upwardly from said second heat transfer section, and a second depression extending downwardly from said second heat transfer section;

said first flow opening of at least one of said first heat exchange plates adjoining said second flow opening of at least one of said second heat exchange plates;

said second depression of said at least one of said first heat exchange plates adjoining said first projection of said at least one of said second heat exchange plates;

a bottom plate mounted in stacked relation to one of said first or second heat exchange plates, said bottom plate including a plurality of downwardly extending depressions; and support feet mounted to said bottom plate, said support feet including a plurality of openings therein, said depressions from said bottom plate extending within said support feet openings.

2. A heat exchanger as defined in claim 1 wherein each of said first heat exchange plates and said second heat exchange plates is substantially rectangular, and each includes a pair of opposing lateral sides and a pair of opposing longitudinal sides.

3. A heat exchanger as defined in claim 2 wherein each of said first and second flow openings of said first heat exchange plates is positioned adjacent to one of the lateral sides thereof.

4. A heat exchanger as defined in claim 3 wherein each of said first projections and second depressions of said first heat exchange plates is positioned substantially between said first and second flow openings thereof.

5. A heat exchanger as defined in claim 1 including a turbulator positioned between each of said first heat exchange plates and second heat exchange plates.

6. A heat exchanger as defined in claim 1 including a top plate mounted in stacked relation to one of said first heat exchange plates or second heat exchange plates, a nozzle including a base portion and a conduit extending from said base portion, at least part of said base portion being locked between said top plate and said one of said first or second heat exchange plates.

7. A plate type heat exchange as defined in claim 1 wherein each of said first and second heat exchange plates include a brazable cladding on both sides thereof.

8. A plate type heat exchanger as defined in claim 1 including a bottom plate mounted in stacked relation to one of said first or second heat exchange plates, said bottom plate including a plurality of downwardly extending depressions.

9. A plate type heat exchanger as defined in claim 8 including support feet mounted to said bottom plate, said support feet including a plurality of openings therein, said depressions from said bottom plate extending within said support feet openings.

10. A plate type heat exchanger as defined in claim 9 wherein each of said depressions extending from said bottom plate is substantially cylindrical.

11. A non-gasketed, plate type heat exchanger comprising:

a plurality of substantially rectangular first heat exchange plates arranged in stacked relation, each of said first heat exchange plates including a first heat transfer section, a peripheral flange extending downwardly from said first heat transfer section, a first depression extending downwardly from said first heat transfer section and including a first flow opening extending therethrough; a second depression extending downwardly from said first heat transfer section and including a second flow opening extending therethrough, a third flow opening defined within said first heat transfer section, a fourth flow opening defined within said first heat transfer section, said first and third flow openings within each of said first heat exchange plates being positioned in opposing relation with respect to said second and fourth flow openings therein;

a plurality of substantially rectangular second heat exchange plates arranged in alternating, stacked relation with said first heat exchange plates, each of said second heat exchange plates including a second heat transfer section, a peripheral flange extending downwardly from said second heat transfer section, a first depression extending downwardly from said second heat transfer section and including a first flow opening extending therethrough; a second depression extending downwardly from said second heat transfer section and including a second flow opening extending therethrough, a third flow opening defined within said second heat transfer section, a fourth flow opening defined within said second heat transfer section, said first and third flow openings within each of said second heat exchange plates being positioned in opposing relation with respect to said second and fourth flow openings therein;

said first, second, third and fourth flow openings of said first heat exchange plates being in fluid communication with said third, fourth, first and second flow openings, respectively, of said second heat exchange plates positioned adjacent thereto;

a plurality of turbulators arranged in alternating, stacked relationship with said first and second heat exchange plates, said turbulators being positioned between said opposing pairs of flow openings defined within said first and second heat exchange plates, respectively;

said first and second depressions of each of said first and second heat transfer plates being in contact with said heat transfer plate positioned immediately below;

said first and second heat transfer plates being respectively brazed to each other and to said respective turbulators.

12. A heat exchanger as defined in claim 11 including a bottom plate mounted to one of said respective first or second heat exchange plates, said bottom plate including at least one depression extending therefrom.

13. A heat exchanger as defined in claim 12 including support means mounted to said bottom plate, said support means including an opening for receiving said depression from said bottom plate.

14. A heat exchanger as defined in claim 11 including a top plate mounted in stacked relation to one of said first heat exchange plates or second heat exchange plates, a nozzle including a base portion and a conduit extending from said base portion, at least part of said base portion being locked between said top plate and said one of said first or second heat exchange plates.

15. A heat exchanger as defined in claim 11 including first and second projections extending from each of said first and second heat exchange plates, each of said first projections being positioned substantially between said first and third flow openings of each heat exchange plate, respectively, said second projections being positioned substantially between said second and fourth flow openings of each heat exchange plate, respectively, said first and second projections contacting said respective heat exchange plates positioned immediately thereabove.

16. A heat exchanger as defined in claim 15 including third and fourth depressions extending from each of said first and second heat exchange plates, said third and fourth depressions contacting said first and second projections, respectively, of the heat exchange plate positioned immediately therebelow.

17. A plate type heat exchanger comprising:

a plurality of first heat exchange plates arranged in stacked relation, each of said first heat exchange plates including a first heat transfer section, a peripheral flange extending downwardly from said first heat transfer section, a first depression extending downwardly from said first heat transfer section and including a first flow opening extending therethrough, and a second flow opening defined within said first heat transfer section;

a plurality of second heat exchange plates arranged in alternating, stacked and nested relation with said first heat exchange plates, each of said second heat exchange plates including a second heat transfer section, a peripheral flange extending downwardly from said second heat transfer section, a first depression extending downwardly from said second heat transfer section and including a first flow opening extending therethrough, and a second flow opening defined within said second heat transfer section;

said first flow opening of at least one of said first heat exchange plates adjoining said second flow opening of at least one of said second heat exchange plates;

a top plate mounted in stacked relation to one of said first heat exchange plates or second heat exchange plates;

a nozzle including a base portion and a conduit extending from said base portion, at least part of said base portion being locked between said top plate and one of said first and second heat exchange plates;

a bottom plate mounted in stacked relation to one of said first or second heat exchange plates, said bottom plate including at least one downwardly extending depression, and supporting means mounted to said bottom plate, said supporting means including an opening for receiving said depression of said bottom plate.

18. A plate type heat exchanger as defined in claim 17 wherein each of said first and second heat exchange plates include a brazable cladding on both sides thereof.

19. A plate type heat exchanger as defined in claim 17 wherein said bottom plate includes a pair of opposing, elongated depressions defined within the upper surface thereof.

20. A plate type heat exchanger comprising:

a plurality of substantially rectangular first heat exchange plates arranged in stacked relation, each of said first heat exchange plates including a pair of opposing lateral sides and a pair of opposing longitudinal sides, each of said first heat exchange plates further including a first heat transfer section, a peripheral flange extending downwardly from said first heat transfer section, a first depression extending downwardly from said first heat transfer section and including a first flow opening extending therethrough, said first flow opening within said first heat exchange plate being located adjacent to one of said lateral sides of said first heat exchange plate, a second flow opening defined within said first heat transfer section, said second flow opening within said first heat transfer section being located adjacent to one of said lateral sides of said first heat exchange plate, a first projection extending upwardly from said first heat transfer section and positioned substantially between said first and second flow openings within said first heat exchange plate, and a second depression extending downwardly from said first heat transfer section and positioned substantially between said first and second flow openings within said first heat exchange plate;

a plurality of substantially rectangular second heat exchange plates arranged in alternating, stacked relation with said first heat exchange plates, each of said second heat exchange plates including a pair of opposing lateral sides and a pair of opposing longitudinal sides, each second heat exchange plate further including a second heat transfer section, a peripheral flange extending downwardly from said second heat transfer section, a first depression extending downwardly from said second heat transfer section and including a first flow opening extending therethrough, a second flow opening defined within said second heat transfer section, said first flow opening within said second heat exchange plate being adjacent to one of said lateral sides of said second heat transfer plate, said second flow opening within said second heat transfer section being adjacent to one of said lateral sides of said second heat exchange plate, a first projection extending upwardly from said second heat transfer section, and a second depression extending downwardly from said second heat transfer section;

said first flow opening of at least one of said first heat exchange plates adjoining said second flow opening of at least one of said second heat exchange plates;

said second depression of said at least one of said first heat exchange plates adjoining said first projection of said at least one of said second heat exchange plates; and a plurality of turbulators arranged in alternating, stacked relation between each of said first heat exchange plates and second heat exchange plates.

21. A plate type heat exchanger as defined in claim 17 including a plurality of turbulators arranged in alternating, stacked relation between each of said first heat exchange plates and second heat exchange plates.

22. A non-gasketed, plate type heat exchanger as defined in claim 11 including a top plate, a nozzle including a base portion and a conduit extending from said base portion, said base portion being positioned at least partially within one of said first or second depressions within one of said first or second heat exchange plates, said top plate being mounted above said base portion of said nozzle.

23. A non-gasketed, plate type heat exchanger as defined in claim 11 wherein said third and fourth flow openings within said respective second heat transfer sections are substantially coplanar with said respective second heat transfer sections.

* * * * *